US008136262B2

(12) United States Patent
Collins

(10) Patent No.: US 8,136,262 B2
(45) Date of Patent: Mar. 20, 2012

(54) DRIER INFORMATION SYSTEM

(75) Inventor: Peter Collins, Witney (GB)

(73) Assignee: Airdri Limited, Oxon (GB)

( * ) Notice: Subject to any disclaimer, the term of this patent is extended or adjusted under 35 U.S.C. 154(b) by 936 days.

(21) Appl. No.: 12/147,725

(22) Filed: Jun. 27, 2008

(65) Prior Publication Data

US 2009/0000140 A1 Jan. 1, 2009

(30) Foreign Application Priority Data

Jun. 29, 2007 (GB) ..... 0712729.3

(51) Int. Cl.
*F26B 19/00* (2006.01)

(52) U.S. Cl. ..... 34/89; 34/90; 34/105; 392/384; 340/679; 340/657; 700/208; 454/252

(58) Field of Classification Search ..... 34/89, 90, 34/105, 201, 202, 218, 242; 340/679, 657; 700/208; 454/252
See application file for complete search history.

(56) References Cited

U.S. PATENT DOCUMENTS

| | | | | |
|---|---|---|---|---|
| 2,944,957 | A * | 7/1960 | Keidel | 204/275.1 |
| 4,430,807 | A * | 2/1984 | Davis et al. | 34/342 |
| 4,531,307 | A * | 7/1985 | Kuecker | 34/552 |
| 4,649,654 | A * | 3/1987 | Hikino et al. | 34/493 |
| 4,914,835 | A * | 4/1990 | Kose et al. | 34/446 |
| 4,916,829 | A * | 4/1990 | Takiue et al. | 34/446 |
| 5,097,606 | A * | 3/1992 | Harmelink et al. | 34/467 |
| 5,245,764 | A * | 9/1993 | Sung | 34/550 |
| 5,291,667 | A * | 3/1994 | Joslin et al. | 34/526 |
| 5,444,924 | A * | 8/1995 | Joslin et al. | 34/486 |
| 5,651,193 | A * | 7/1997 | Rhodes et al. | 34/531 |
| 6,792,694 | B2 * | 9/2004 | Lapierre | 34/446 |
| 6,845,290 | B1 * | 1/2005 | Wunderlin et al. | 700/208 |
| 6,996,920 | B2 * | 2/2006 | Bang et al. | 34/494 |
| 7,013,578 | B2 * | 3/2006 | Wunderlin et al. | 34/528 |
| 7,478,486 | B2 * | 1/2009 | Wunderlin et al. | 34/491 |
| 7,721,462 | B2 * | 5/2010 | Park et al. | 34/319 |
| 2003/0230005 | A1 * | 12/2003 | Lapierre | 34/606 |
| 2004/0066303 | A1 * | 4/2004 | Chernetski | 340/679 |
| 2004/0200093 | A1 * | 10/2004 | Wunderlin et al. | 34/606 |
| 2005/0016013 | A1 * | 1/2005 | Bang et al. | 34/486 |
| 2005/0155251 | A1 * | 7/2005 | Lee | 34/604 |
| 2005/0278974 | A1 * | 12/2005 | Chung | 34/528 |
| 2006/0085996 | A1 * | 4/2006 | Hwang | 34/82 |
| 2006/0191161 | A1 * | 8/2006 | Wunderlin et al. | 34/562 |
| 2006/0207121 | A1 * | 9/2006 | Lee | 34/89 |
| 2007/0101605 | A1 * | 5/2007 | Susalla | 34/202 |
| 2007/0180728 | A1 * | 8/2007 | Kim et al. | 34/88 |

(Continued)

FOREIGN PATENT DOCUMENTS

EP 151184 A1 * 8/1985

(Continued)

*Primary Examiner* — Stephen M. Gravini
(74) *Attorney, Agent, or Firm* — Davis & Bujold, P.L.L.C.

(57) ABSTRACT

A drier information system is provided including display means relating to a given region of the system which means serves, at least while a drying cycle is in operation, to provide a visual display indicating at least one of the following parameters: the extent of the region; a boundary of the region; direction or example of manipulation of a pair of hands or other article while in the region to provide for a preferred drying sequence. The visual display can represent the parameters as a two dimensional array within or adjacent the region. Alternatively the visual display can represent the parameters as a virtual or actual three dimensional array within or adjacent the region.

15 Claims, 2 Drawing Sheets

U.S. PATENT DOCUMENTS

| | | | | |
|---|---|---|---|---|
| 2008/0072450 | A1* | 3/2008 | Kim et al. | 34/524 |
| 2008/0148592 | A1* | 6/2008 | Kim et al. | 34/89 |
| 2009/0000140 | A1* | 1/2009 | Collins | 34/89 |
| 2009/0071032 | A1* | 3/2009 | Kreutzfeldt et al. | 34/389 |
| 2009/0090020 | A1* | 4/2009 | Choi et al. | 34/88 |
| 2009/0211108 | A1* | 8/2009 | Moschutz et al. | 34/491 |
| 2009/0282695 | A1* | 11/2009 | Kreutzfeldt et al. | 34/443 |
| 2009/0293304 | A1* | 12/2009 | Yang | 34/547 |
| 2010/0077633 | A1* | 4/2010 | Bae et al. | 34/90 |

FOREIGN PATENT DOCUMENTS

| | | | | |
|---|---|---|---|---|
| FR | 2906447 | A1 | * | 4/2008 |
| GB | 2433886 | A | * | 7/2007 |
| JP | 56048613 | A | * | 5/1981 |
| JP | 61070334 | A | * | 4/1986 |
| JP | 04028533 | A | * | 1/1992 |
| JP | 06023197 | A | * | 2/1994 |
| JP | 06030879 | A | * | 2/1994 |
| JP | 06273048 | A | * | 9/1994 |
| JP | 07012464 | A | * | 1/1995 |
| JP | 07103656 | A | * | 4/1995 |
| JP | 07213545 | A | * | 8/1995 |
| JP | 08131310 | A | * | 5/1996 |
| JP | 11063837 | A | * | 3/1999 |
| JP | 2000079299 | A | * | 3/2000 |
| JP | 2001000798 | A | * | 1/2001 |
| JP | 2001059948 | A | * | 3/2001 |
| JP | 2003091023 | A | * | 3/2003 |
| JP | 2003186058 | A | * | 7/2003 |
| JP | 2003186059 | A | * | 7/2003 |
| JP | 2003186060 | A | * | 7/2003 |

* cited by examiner

DRIER INFORMATION SYSTEM

TECHNICAL FIELD

This invention relates to a drier information system. In particular it is concerned with an information system for use, though not exclusively, with what is often described as a hand dryer. Many types of hand drier are used in a wide range of sites including washrooms in public, commercial and other locations.

Conventionally a drier is usually a box like structure attached to a wall. Instructions for use are often provided for a drier whether in words or pictures or both. It has become apparent from surveys and inspections that a user can have difficulty in understanding of such instructions. For example when the words in a display are in a language foreign to the potential user. It is not uncommon for a user with wet hands to try and activate the dryer with a contact action such as operating a switch. Most modern driers do not require initiating action from a user apart from positioning their hands in a drying location adjacent an air outlet from the structure. The drying location is scanned by a proximity device to establish whether an object is positioned there. Given an object is detected a control system for the drier will automatically initiate and carry out a drying cycle. The drying location while being functionally related to the structure is not always clearly related to the structure of the drier nor is the boundaries of the location necessarily apparent.

Many types of drier have no parts requiring manipulation by the user in order for the drier to function. However a drier is in use equipped with a nozzle angled relative to the drier structure and through which a jet of heated air is directed during the drying cycle. With the nozzle pointing in a first direction the hands of a user can be dried. The nozzle can then be turned to point in a different direction, for example to enable the face of the user to be dried. However if the nozzle is left pointing in a face drying direction a subsequent uniformed user may find drying their hands to be problematic.

There thus arises a need for a user, especially an inexperienced or unassertive one, to be provided with unambiguous directions as to the use of the drier.

DISCLOSURE OF INVENTION

According to the present invention there is provided a drier information system including display means relating to a given region of the system which means serves, at least while a drying cycle is in operation, to provide a visual display indicating at least one of the following parameters:

the extent of the region;

a boundary of the region;

direction or example of manipulation of a pair of hands or other article within the region to provide a preferred drying sequence.

BRIEF DESCRIPTION OF DRAWING

An exemplary embodiment of the present invention will now be described with reference to the accompanying drawings of a hand drier having a control system and display means of which.

MODE FOR CARRYING OUT THE INVENTION

Figure 1:
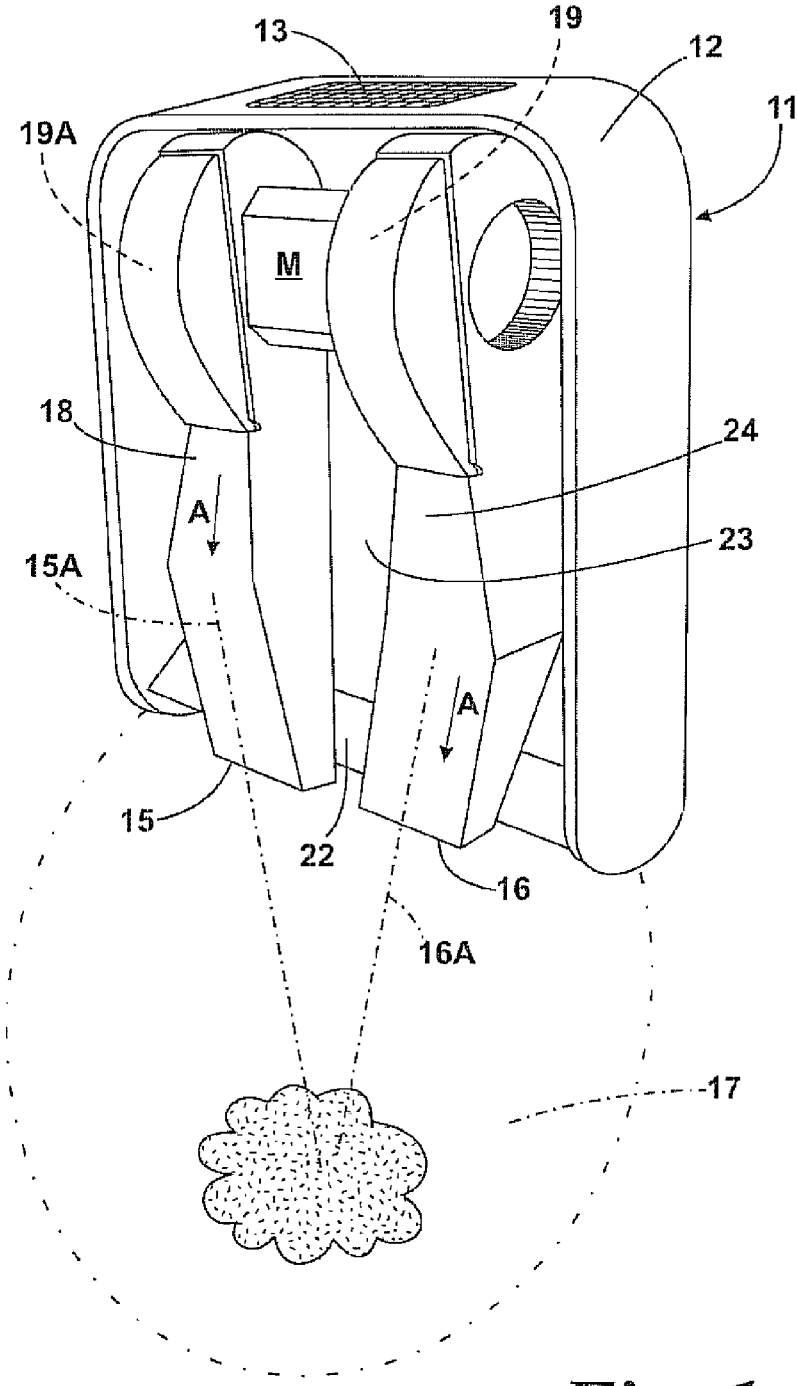
FIG. 1 is a diagrammatic front and side elevation of the drier with a cover removed.

The drawing shows a drier unit 11 with a housing 12 having a front panel which is not shown. The housing 12 incorporates an air inlet 13 and an air outlet comprising a pair of apertures 15, 16. For other applications more than two apertures can be used. The apertures 15, 16 open into a drying area 17 beneath the housing 12. The apertures 15, 16 each have a flow axis, respectively axis 15A, 16A along which air is caused to flow through the associated aperture.

The air inlet 13 and air aperture 15 are linked within the housing by a duct 18 in which a fan 19A, drivable by motor M, is located to provide for driving of air along the duct 18 in the direction of arrow A towards the air outlet 15.

The drier unit 11 also incorporates a proximity sensing device 22 and control means 23. The proximity device 22 serves to detect the insertion of an object, such as a pair of hands, into the drying area 17. A drying cycle is then initiated by way of the control means 23 in which cycle the fan 18 is operated causing in air to be driven along the duct 18 from the air inlet 13 to the air outlet 15. In passing along the duct 18 the air is heated by an electrical element (not shown) with a resulting provision of hot air into the drying area 1 emitted from the apertures 15.

The air inlet 13 and air aperture 16 are linked within the housing by a duct 24 in which a further fan 19B, also drivable by motor M, is located to provide for driving of air along the duct 24 in the direction of arrow A towards the air outlet 16.

The axis 15A, 16A are so directed that the air outputs A1, A2 from, respectively, the apertures 15, 16 interact peripherally to generate vortices in the drying area 17. The main body of heated air flow has sufficient kinetic energy to displace water and vapour from the surface of the object while the vortices considerably enhance the drying effect. The effect of enhancement has been found to both improve on the conventional drying cycle available from existing drier types and also to provide a comfortable physiological effect.

Figure 2:
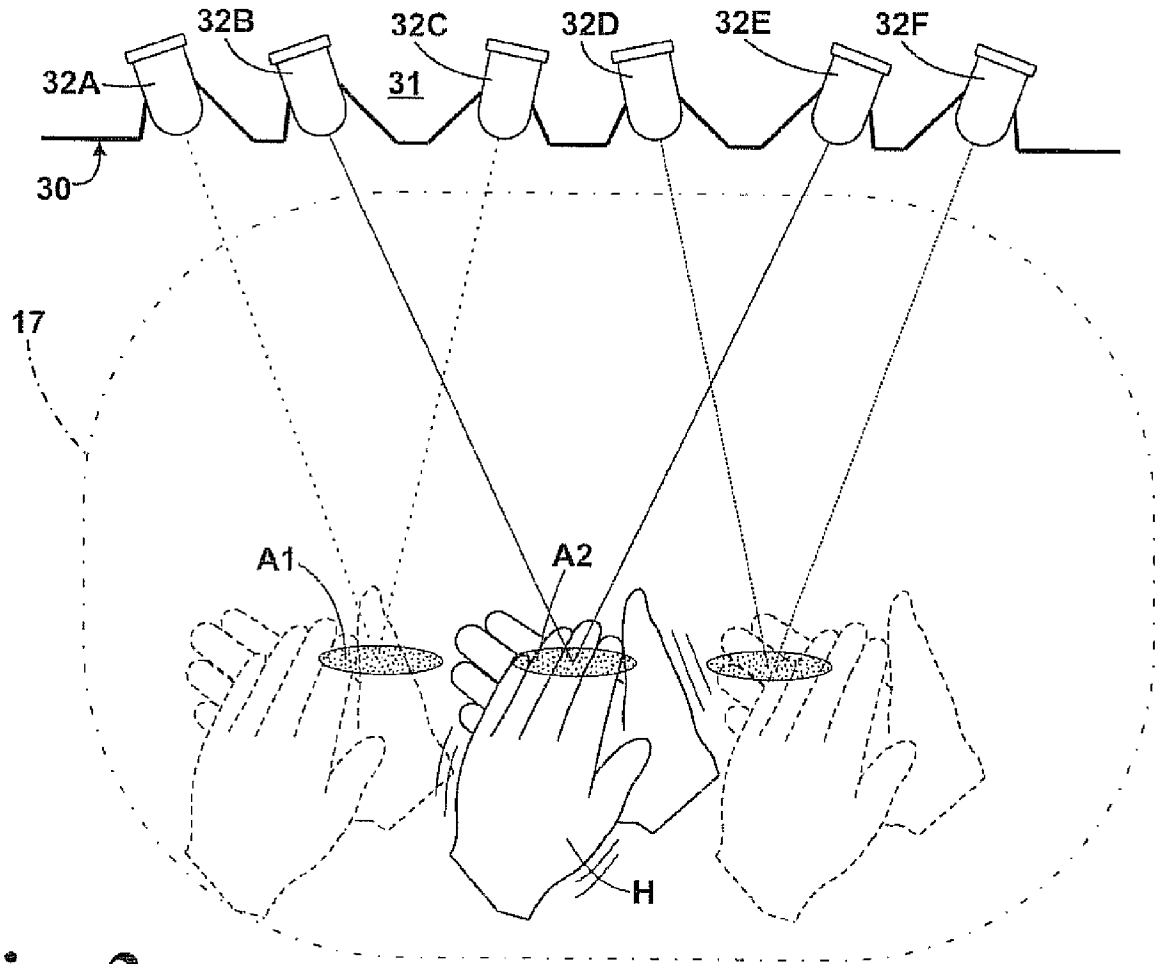
FIG. 2 is a diagrammatic front view of a part of the drier of FIG. 1 with additional feature.

The unit 11 incorporates at its lower end a display unit 30 which is shown in more detail in FIG. 2. The unit 30 comprises a carrier 31 in which are mounted light emitting diodes 32A to F with their individual axis set at an angle so that pairs of diodes combine when energised to illuminate a particular area of three such areas as follows;

| Diode Pair | Illuminate Area |
|---|---|
| 32A, C | A1 |
| 32B, E | A2 |
| 32D, F | A3. |

To initiate a drying cycle a pair of wet hands H is placed in drying location 17 for detection by proximity sensor 18 which serves to start the fan 16 and energise the heater. The fan 16 displaces air along the duct 15 for emission from the outlets 13 into the location 17 for a predetermined period.

The diode pairs can be programmed so that a sequence of areas A1 to A3 can be illuminated to different light levels to make an un-ambiguous on-going indication to a user to move their hands to and from or in some other pattern across the drying location 17 (typically while rubbing the hands together) to optimise the drying process to be obtained form the drier.

In an alternative embodiment rather than providing for a spatial image (resulting from the beams of the diode pairs) the drier of the present invention can include in its casing a display means adapted to project images onto the wall or nearby location to the drier The display provides for the projection of the boundary of the drying location so as to be viewed by a user or intending user in front of the drier. Such a display would consume little power and can be provided by a number of possible light sources including low power lasers. Typically for this embodiment a proximity sensor in the drier on detecting the presence of hands in the drying location an image is projected onto the wall a display of a pair of hands being rubbed over one another to demonstrate an effective way of drying hands by spreading water on the hands as a thin layer over the hands while in a stream of drying air from the heater outlets. Once the cycle is complete the virtual hands are shown being withdrawn to allow the completion of the automatic drying cycle. It will be apparent that this form of information display does not involve the use of written (or spoken) language and can be readily comprehended by a user.

Such a display system can be used to display a wide range of information. Thus the initial display prior to a heating cycle being initiated can show a pair of separate wet hands so that a user is made aware of the purpose of the location.

INDUSTRIAL APPLICABILITY

The invention provides for hand and other driers to be of improved user operation and user friendliness and also providing for power saving.

The invention claimed is:

1. A drier unit incorporating a drier information system comprising:

a housing including a fan contained within a fan chamber;

a motor for supplying rotational drive to the fan;

an air inlet for supplying air to the fan chamber;

an air outlet coupled with the fan for delivering air from the fan to a drying area;

a duct for transferring air through the housing from the inlet to the outlet via the fan chamber, and the fan being operable by the motor for causing the air to be displaced along the duct from the inlet to the outlet;

a proximity sensing device coupled to a control means for detecting insertion of an object to be dried into the drying area and initiating actuation of a drying cycle of the drier unit;

wherein the drier information system is located adjacent to the outlet and coupled to the control means for providing a visual display in the drier area to a user, and the drier information system, upon actuation of the drying cycle of the drier unit, indicating at least one of an extent of the drying area and a boundary of the drying area; and the visual display is manipulatable by the control means for visually displaying locations of at least first and second discrete drying areas and thereby indicating a desired manipulation of the object to be dried, when located within the drying area, and providing a desired drying sequence for the object to be dried.

2. The drier unit incorporating a drier information system according to claim 1, wherein the visual display is represented as a two dimensional array within or adjacent to the drying region.

3. The drier unit incorporating a drier information system according to claim 1, wherein the visual display is one of a virtual and an actual three dimensional array within or adjacent to the drying region.

4. The drier unit incorporating the drier information system according to claim 1, wherein the visual display displays a location of a third discrete drying area and the visual display is manipulatable, by the control means, for visually displaying the desired manipulation of the object to be dried and providing a desired drying sequence for the object to be dried utilizing a desired sequence of the location of the first, the second and the third discrete drying areas.

5. The drier unit incorporating the drier information system according to claim 1, wherein the drier information system comprises a plurality of light emitting diodes supported adjacent to the outlet, and the plurality of light emitting diodes are selectively illuminated to provide the visual display in the drier area to the user.

6. A drier unit incorporating a drier information system, the drier unit comprising:

a housing including a fan contained within a fan chamber;

a motor for supplying rotational drive to the fan;

an air inlet for supplying air to the fan chamber;

an outlet aperture coupled with the fan chamber for delivering air from the fan along a drying axis to a drying area;

a duct for facilitating transfer of the air through the housing from the inlet to the outlet aperture via the fan chamber while the fan is operated by the motor to cause the air to be displaced along the duct from the inlet to the outlet aperture; and a proximity sensing device being coupled to a control means for detecting insertion of an object to be dried into the drying area and initiating actuation of a drying cycle of the drier unit;

wherein the drier area comprises at least first and second discrete drying areas;

the drier information system is located adjacent to the outlet aperture and coupled to the control means for providing a visual display in the drier area to a user, and the drier information system, upon actuation of the drying cycle of the drier unit, indicating at least one of an extent of the drying area and a boundary of the drying area; and the visual display is manipulatable, by the control means, for visually displaying a location of the first discrete drying area and then a location of the second discrete drying area and thereby indicating a desired manipulation of the object to be dried and providing a desired drying sequence for the object to be dried.

7. The drier unit incorporating the drier information system according to claim 6, wherein the visual display is represented as a two dimensional array within or adjacent to the drying area.

8. The drier unit incorporating the drier information system according to claim 6, wherein the visual display is one of a virtual and an actual three dimensional array within or adjacent to the drying area.

9. The drier unit incorporating the drier information system according to claim 6, wherein the visual display displays a location of a third discrete drying area and the visual display is manipulatable, by the control means, for visually displaying the desired manipulation of the object to be dried, when located within the drying region, and providing a desired drying sequence for the object to be dried utilizing a desired sequence of the location of the first, the second and the third discrete drying areas.

10. The drier unit incorporating the drier information system according to claim 6, wherein the drier information system comprises a plurality of light emitting diodes supported adjacent to the first and the second outlet apertures, and the plurality of light emitting diodes are selectively illuminated to provide the visual display in the drier area to the user.

11. A drier unit incorporating an information system, the drier unit comprising:

a housing including a first fan contained within a first fan chamber and a second fan contained within a second fan chamber;

a motor for supplying rotational drive to the first fan and the second fan;

an air inlet for supplying air to the first fan chamber and the second fan chamber;

a first air outlet aperture coupled with the first fan chamber for delivering air from the first fan along a first drying axis to a drying area;

a second air outlet aperture coupled with the second fan chamber for delivering air from the second fan along a second drying axis to the drying area;

ducts for facilitating transfer of the air through the housing from the inlet to the first and the second outlet apertures via the first fan chamber and the second fan chamber when the first and the second fans are operated by the motor to cause the air to be displaced along the duct from the inlet to the first and the second outlet apertures; and a proximity sensing device being coupled to a control means for detecting insertion of a pair of hands to be dried into the drying area and initiating actuation of a drying cycle of the drier unit;

wherein the drier area comprises at least first and second discrete drying areas;

the drier information system is located adjacent to the first and the second outlet apertures and coupled to the control means for providing a visual display in the drier area to a user, upon actuation of the drying cycle of the drier unit, indicating at least one of an extent of the drying area and a boundary of the drying area; and the visual display is manipulatable by the control means for visually displaying a location of the first discrete drying area and then a location of the second discrete drying area and thereby indicating a desired manipulation of the pair of hands to be dried and providing a desired drying sequence for the pair of hands to be dried.

12. The drier unit incorporating the drier information system according to claim 11, wherein the visual display is represented as a two dimensional array within or adjacent to the drying area.

13. The drier unit incorporating the drier information system according to claim 11, wherein the visual display is one of a virtual and an actual three dimensional array within or adjacent to the drying area.

14. The drier unit incorporating the drier information system according to claim 11, wherein the visual display displays a location of a third discrete drying area and the visual display is manipulatable by the control means for visually displaying the desired manipulation of the pair of hands to be dried, when located within the drying region, and providing a desired drying sequence for the pair of hands to be dried utilizing a desired sequence of the location of the first, the second and the third discrete drying areas.

15. The drier unit incorporating the drier information system according to claim 11, wherein the drier information system comprises a plurality of light emitting diodes supported adjacent to the first and the second outlet apertures, and the plurality of light emitting diodes are selectively illuminated to provide the visual display in the drier area to the user.

* * * * *